US005460345A

United States Patent [19]

Trevaskis

[11] Patent Number: 5,460,345

[45] Date of Patent: Oct. 24, 1995

[54] ADJUSTABLE MERCHANDISE DISPLAY SYSTEM

[75] Inventor: Thomas R. Trevaskis, Moorabbin, Australia

[73] Assignee: Trevola Holdings Pty Ltd, Moorabbin, Australia

[21] Appl. No.: 131,628

[22] Filed: Oct. 5, 1993

[51] Int. Cl.[6] ..... A47B 57/00

[52] U.S. Cl. ..... 248/225.21; 248/242; 248/222.13; 211/175; 211/59.1

[58] Field of Search ..... 248/220.2, 242, 248/291, 294, 514, 251; 108/6; 211/170, 171, 99, 193, 105.1, 59.1, 175

[56] References Cited

U.S. PATENT DOCUMENTS

| | | | |
|---|---|---|---|
| 1,466,859 | 4/1923 | Sutton | 211/99 |
| 1,995,983 | 3/1935 | Hesse | 211/99 X |
| 2,136,109 | 11/1938 | Kress | 248/242 X |
| 2,755,055 | 7/1956 | Kreuscher | 248/291 |
| 3,149,811 | 9/1964 | Fremstad et al. | 248/251 |
| 3,850,401 | 11/1974 | Snediker | 248/291 |
| 4,314,685 | 2/1982 | Schwan | 248/242 |
| 4,583,648 | 4/1986 | Buffington | 248/242 X |
| 4,785,190 | 11/1988 | Frankena | 248/242 X |
| 4,936,565 | 6/1990 | Fredrickson | 211/59.1 |
| 5,303,830 | 4/1994 | Metcalf | 211/59.1 X |

FOREIGN PATENT DOCUMENTS

| | | | |
|---|---|---|---|
| 15273/83 | 6/1983 | Australia . | |
| 77169/87 | 2/1988 | Australia . | |
| 1419809 | 10/1965 | France | 248/242 |
| 1233370 | 5/1971 | United Kingdom | 211/59.1 |

*Primary Examiner*—Blair M. Johnson
*Attorney, Agent, or Firm*—Jacobson, Price, Holman & Stern

[57] ABSTRACT

An adjustable merchandise display system mounted on a generally vertical, apertured support surface or support members including a plurality of clips supporting a generally horizontal load bearing bar. Each of the clips is flat and of planar form with spaced hooks on the outer edge thereof to support the clips in a vertical plane at right angles to the support surface. Each clip includes a through aperture that is serrated to cooperate with the bar whereby the bar is non-rotatably engaged through the apertures to enable the bar to be supported in a plurality of angularly displaced attitudes about the longitudinal axis of the bar. End supports in the form of cantilever brackets having inner ends engageable with the bar support merchandise for display or storage.

5 Claims, 3 Drawing Sheets

ADJUSTABLE MERCHANDISE DISPLAY SYSTEM

This invention relates to "gondola" and suchlike devices or systems for carrying articles of merchandise for display and/or storage purposes.

Our invention is particularly, but not exclusively, concerned with the display and/or storage of rope, twine and other flexible linear commodities wound onto reels or "cones". These usually consist of a hub on which the rope etc. is wound, and relatively large discs at or near each end of the hub for confining the windings and for facilitating the handling of the article, such as by allowing it to be conveniently rolled along a floor. The hubs may extend axially beyond the discs with a flange at each end, providing a space between the disc and flange to receive a bar, or rail of a bracket or like support.

A typical "gondola" assembly includes a suitably supported vertical frame or "peg-board" defining an array of holes for receiving pegs or hook-portions of brackets which having been positioned are adapted, in co-operation with the board, to hold the bracket securely cantileverwise extending out from the board to provide a firm support for bars, shelves or the like. Alternatively, shelves themselves may have a hook portions for reception in the holes of the main support board.

The array of holes is usually square or rectangular and of generally constant "pitch" vertically and horizontally.

Accordingly the present invention provides a support system for an article to be held, between supports at each end thereof, relative to a fixed vertical structure, the system being detachably fastenable to the structure and including a horizontal bar which at least in part is of generally polygonal outer cross-section, said end supports including cantilever brackets having inner ends engageable with said bar, dips removably securable to the structure and each defining an aperture adapted to receive the polygonal bar and shaped to provide for the bar a plurality of stable support positions in angularly displaced attitudes with respect to a longitudal axis of the bar.

But in order that the invention may be better understood reference will now be made to the accompanying drawings which are to be considered as part of this specification and read herewith. In the drawings.

Figure 1:
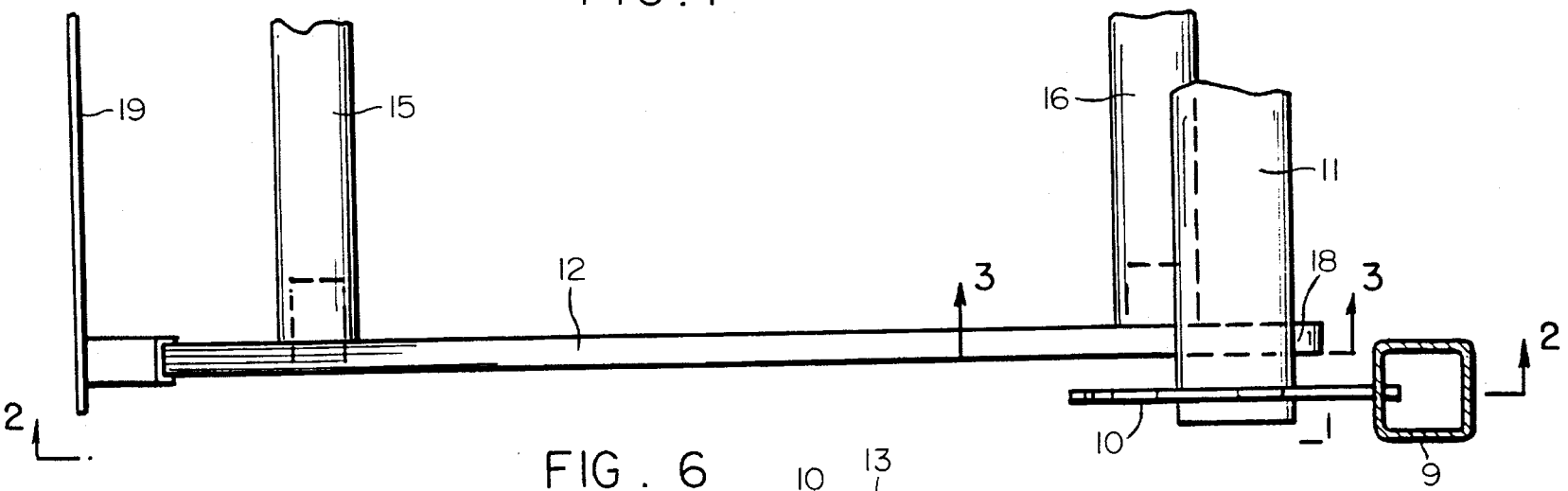
FIG. 1 shows a top plan of a system, according to a practical embodiment of the invention, for supporting one end of a reel, it being understood that a similar system is provided for the other end.

Referring to the drawings in more detail, there is shown one of two end supports for a reel 8, for holding the reel on a cantilever-like system extending outwardly from a fixed vertical structure represented by a regularly-apertured peg-board 9 of a kind known per se. The system or support consisting essentially of clip 10, bar 11 and bracket 12 is detachably fastenable to peg-board 9 by outer peripheral means on dip 10 shown as hooks 13 spaced correspondingly to the apertures in peg-board 9.

Bar 11 is of generally polygonal outer cross-section, or at least it has parts of such cross-section, so as to be receivable in stable or non-rotational relationship within apertures 14 in clips 10. In the illustrated embodiment the bar is of substantially square cross-section and, correspondingly, the dip's aperture is serrated with 90° "teeth" to fit the bar corners, as best shown in FIGS. 2 and 6.

Cantilever-like brackets such as 12 support rods 15, 16 upon which rest end-flanges such as 17 of reel 8. Rear hooked portions 18 of brackets 12 are engageable within suitably spaced apertures in bar 11. The nature of the cable, twine etc. wound on reel 8 may be identified by means of a display strip or panel 19 attachable across the front portions of the relevant supports.

Figure 6:
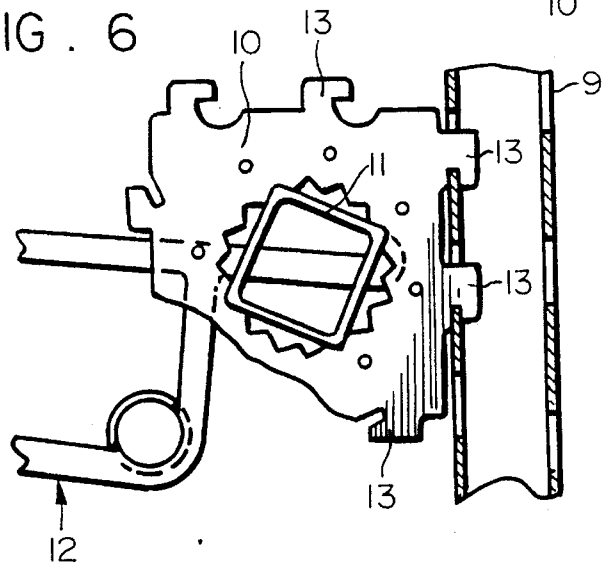
FIG. 6 shows, in contrast to that shown in FIG. 2, an alternative support position for the bar and bracket by the dip.
Figure 3:
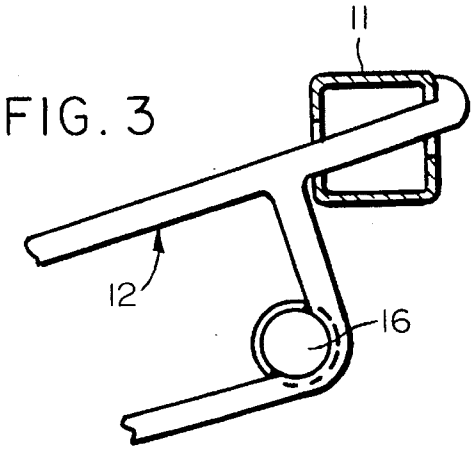
FIG. 3 is a section across line 3—3 in FIG. 1.
Figure 2:
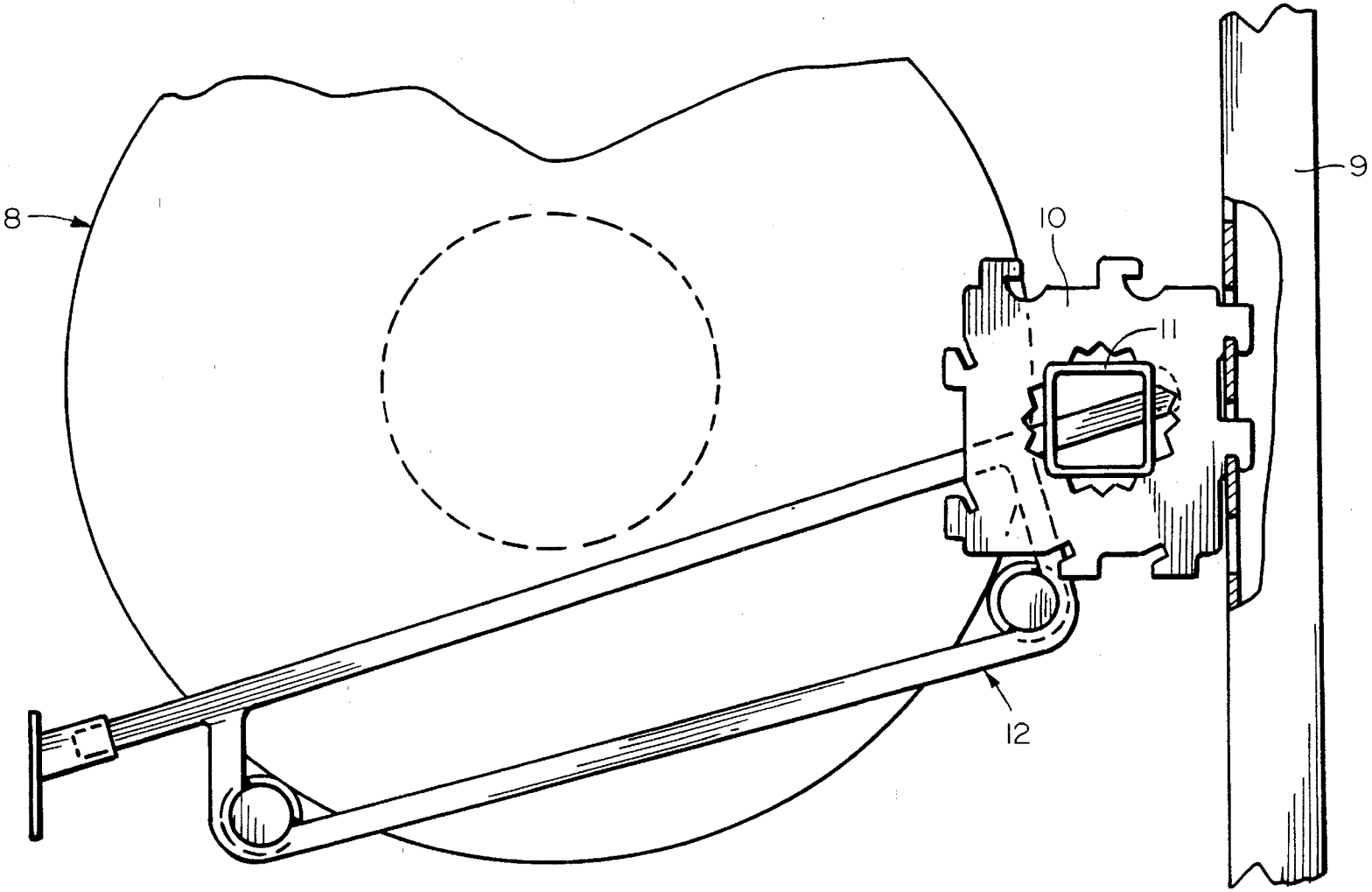
FIG. 2 is a part section part side elevation of the system shown in FIG. 1, across line 2—2 shown thereon.
Figure 4:
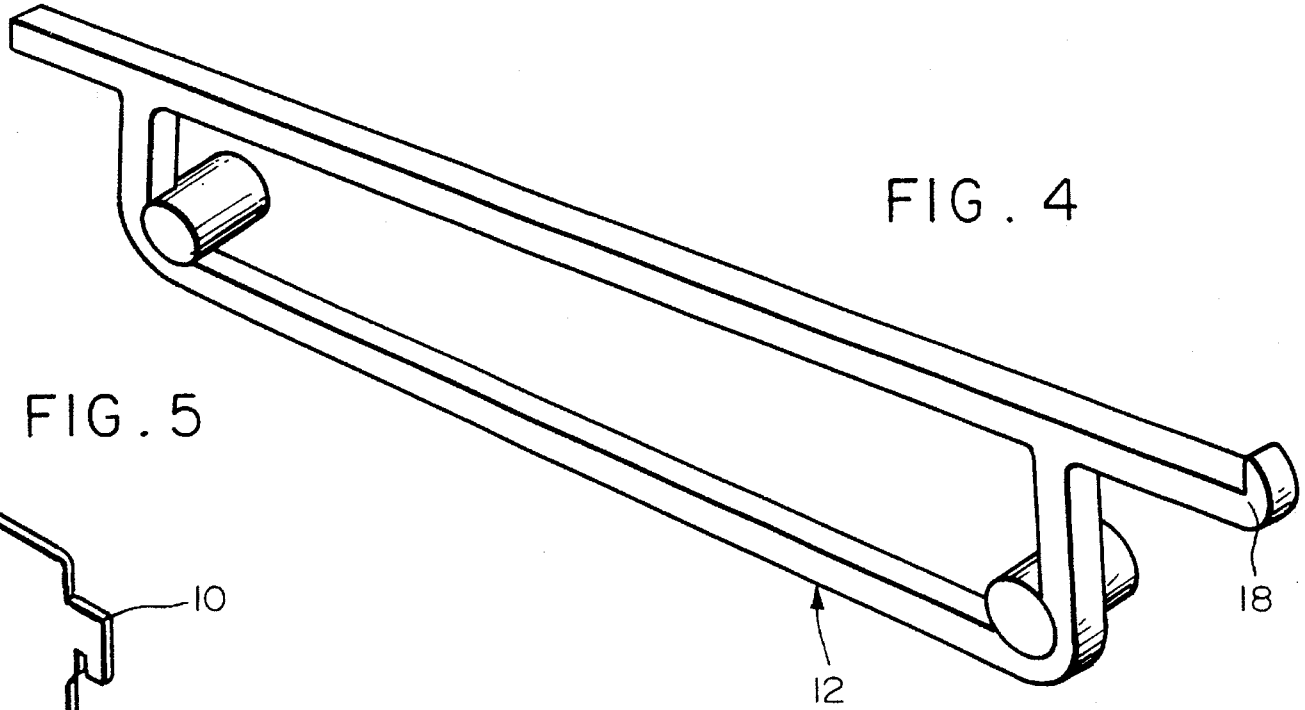
FIGS. 4 and 5 are, respectively, perspective views of a reel support bracket and a bar-supporting dip, being parts of the system shown in FIGS. 1, 2 and 3.

As best seen by comparing FIGS. 2 and 6, the shape of aperture 14 in clip 10 is related to the outer cross-section of bar 11 so as to provide a plurality of stable support positions for the bar around its axis. Thus in FIG. 2 there is shown a position wherein the bar is engaged by the dip such that bracket 12, which is connected to the bar, is somewhat declined from the horizontal. However in the attitude shown in FIGS. 6 the bar is turned somewhat clockwise relative to its FIG. 2 position and correspondingly the bracket is somewhat raised.

A bar such as 11 forming part of the support system for one or a number of reels or cones e.g. a row of horizontally-spaced cones, may be hollow and of square or rectangular section. One or more sides of the bar may be apertured to receive bracket hooks or the like for supporting cones as aforesaid, or other articles. Apertures in different sides of the bar may be of differing shape, size and/or "pitch" (spacing), but apertures in the same side need not necessarily be uniform in any of these respects.

If desired, one side or two adjacent sides of the bar could be apertured for pegging to peg-board 9. Advantageously, however, the bar is additionally or alternatively supported between dips such as 10 at each of its ends, the dips being themselves adapted for secure fastening to the board e.g. by two or more hooks adapted to be received and held within vertically-spaced holes in the peg-board.

The illustrated preferred embodiment of bar-supporting dip is of generally flat, square configuration with two or more suitably-spaced hooks or tabs 10 projecting from one or more sides of the square, and the specially-shaped central aperture 14 (to be described more fully hereinbelow) for receiving bar 11, or at least an end portion thereof, in close-fitting relationship.

Figure 7:
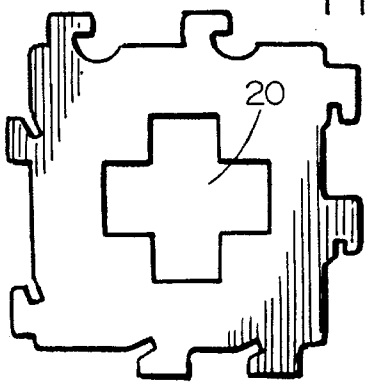
FIG. 7 shows, in contrast to that shown in FIGS. 2, 5 and 6, an alternative dip configuration.

By "suitably-spaced" in relation to the hook or tab spacing, is meant that the tabs are spaced in accordance with the hole-spacing ("pitch") of peg-board 9. Clearly the tab spacing should be equal to the pitch of the board, or an integral multiple thereof. However different manufacturers tend to use different hole-pitches. With this in view we may provide different hook or tab spacings on different sides of the clip, as illustrated in FIG. 7, which additionally illustrates a cruciform aperture 20 capable of receiving a rectangular section bar.

The bar-receiving aperture could be of substantially complementary shape to the outer contour of the bar. This, in the case of a square bar, would clearly permit of four different bar orientations with respect to the board.

Preferably however, the aperture is specially shaped so as to be capable of securely receiving and supporting the bar in one or more orientations or attitudes mutually inclined at less than 90°.

Figure 5:
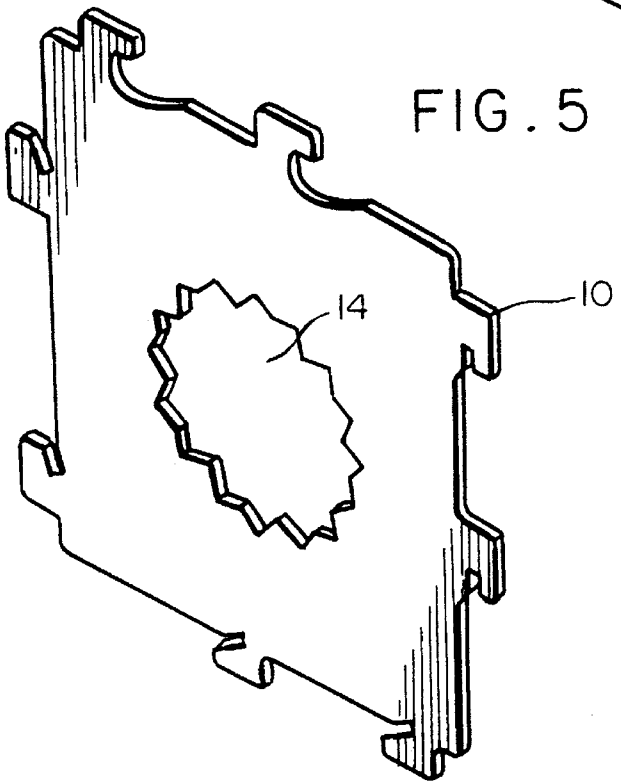

For this purpose the aperture may have an outline or periphery serrated in a radially symmetric configuration, as shown in FIGS. 2, 5 and 6. If the bar be square, an ordinary square aperture would, as previously indicated, afford four different attitudes or rotational configurations for the bar. Such an aperture might be considered as having a serrated circular outline with four "teeth" at 90° spacing.

An eight-tooth configuration could provide four additional bar positions or attitudes. Assuming the outline were radially symmetric, then successive positions would be at 45°.

The accompanying FIGS. 2, 5 and 6 illustrate a sixteen-position square bar-supporting dip according to our invention, there being sixteen "teeth" inclined, each to the next at 22½°.

The supports are by no means necessarily limited to bars of square cross-section. Apertures such as 20 (FIG. 7) may be shaped for multi-positioning of rectangular and other cross-section bars.

In general, for maximum security of support, the apical angle of the teeth will correspond to the cross-sectional angles of the bar. Thus for a square or rectangular bar, the teeth will usually be rightangled, although for a non-square bar they will usually be asymmetric with respect to a radial line through the apex of the "tooth".

It may be convenient to consider the aperture outline as being geometrically constructed on the basis of two concentric circles, on which lie respectively the outer and inner vertices of the serrations. Clearly the radius (call it R) of the outer circle will be equal in length to half of the diagonal of the outer cross section of the bar. The radius (r) of the inner circle may be given by $$R = r\left(\sin\frac{\pi}{n} + \cos\frac{\pi}{n}\right)$$

where n is the number of "rotational" positions the bar is required to assume. For a basic square (4-position) aperture referred to above with four "points"

$$\begin{aligned} R &= \left(\sin\frac{\pi}{4} + \cos\frac{\pi}{4}\right) \\ &= r(\sin 45° + \cos 45°) \\ &= r\sqrt{2} \end{aligned}$$

which agrees with geometrical notions for a square outline, because the outer and inner circles will necessarily be those respectively circumscribed about, and inscribed in, the square.

For the illustrated sixteen-position bar-supporting clip $$\begin{aligned} R &= r\left(\sin\frac{\pi}{16} + \cos\frac{\pi}{16}\right) \\ &= r(\sin 11°15' + \cos 11°15') \\ &\approx 1.18r \end{aligned}$$

It will be appreciated that, in general, the dip(s) and bar will need to be separated when it is desired to change the angle of the bar.

It will be evident from the foregoing that the supporting system provided by our invention is extremely simple and versatile.

The claims defining the invention are as follows:

1. A support system for an article, comprising supports for holding the article at each end thereof, relative to a fixed vertical structure, the system being detachably fastenable to the structure and including a horizontal bar which at least in part is of generally polygonal outer cross-section, said end supports including cantilever brackets having inner ends engageable with said bar, dips removably securable to the structure and each defining an aperture adapted to receive the polygonal bar and shaped to provide for the bar a plurality of stable support positions in angularly displaced attitudes with respect to a longitudinal axis of the bar.

2. A plurality of substantially rigid clips for mounting on a gondola support system including a generally vertical, apertured support surface, each of said clips functionable to provide a complete but removable support, a load-bearing bar that is subject to forces tending to twist said bar about its longitudinal axis, said bar being supported in a horizontal position parallel to the support surface by said plurality of clips each of said clips being generally flat and of planar form having spaced hook means on an outer edge thereof to hold the clips in a vertical plane at right angles to the support surface and to the bar, each clip including a through aperture receiving said bar, said aperture being serrated to cooperate with a complementary formation on the outside of said bar whereby the bar is engageable non-rotatably through the aperture in the clip in a selected one of a plurality of stable support positions in angularly displaced attitudes with respect to said axis, and in each of which support positions the bar is prevented, by said serrations in the aperture in the clip, from rotation under said twisting forces.

3. A clip as claimed in claim 2 wherein the aperture's periphery is serrated in a radially symmetric configuration to accommodate a bar of regular-polygonal cross-section of N sides to provide N different bar orientations spaced, each from the next, by 360/N degrees.

4. A clip as claimed in claim 3 wherein the apical angle of the serrations corresponds to the internal angles of the polygonal cross section of the bar.

5. A clip as claimed in claim 4 geometrically based on two concentric circles on which lie respectively outer and inner vertices of the serrations, the radii of the outer (R) to the inner (r) circles being in the ratio $$\left(\sin\frac{\pi}{n} + \cos\frac{\pi}{n}\right)$$

where n is the number of "rotational" positions the bar is required to assume.

* * * * *